US009638217B2

(12) United States Patent
Yang

(10) Patent No.: US 9,638,217 B2
(45) Date of Patent: May 2, 2017

(54) LIFTING SYSTEM AND LIFTING METHOD FOR JIB OF AN OPERATING MACHINE, AND AN OPERATING MACHINE THEREOF

(76) Inventor: Shuanglai Yang, Heilongjiang (CN)

( * ) Notice: Subject to any disclaimer, the term of this patent is extended or adjusted under 35 U.S.C. 154(b) by 455 days.

(21) Appl. No.: 14/006,342

(22) PCT Filed: Dec. 26, 2011

(86) PCT No.: PCT/CN2011/084636

§ 371 (c)(1),
(2), (4) Date: Sep. 20, 2013

(87) PCT Pub. No.: WO2012/126266

PCT Pub. Date: Sep. 27, 2012

(65) Prior Publication Data

US 2014/0000250 A1 Jan. 2, 2014

(30) Foreign Application Priority Data

Mar. 21, 2011 (CN) ..... 2011 1 0067311
Dec. 12, 2011 (CN) ..... 2011 1 0412723

(51) Int. Cl.
*E02F 9/22* (2006.01)
*F15B 1/02* (2006.01)
(Continued)

(52) U.S. Cl.
CPC ..... *F15B 13/02* (2013.01); *B66C 13/20* (2013.01); *E02F 9/226* (2013.01); *E02F 9/2217* (2013.01);
(Continued)

(58) Field of Classification Search
CPC ..... F15B 1/024; F15B 21/14; F15B 11/024; E21B 19/00; E21B 23/08; E02F 9/20
(Continued)

(56) References Cited

U.S. PATENT DOCUMENTS 6,267,041 B1 * 7/2001 Skiba ..... F15B 11/024 91/436
6,592,336 B1 * 7/2003 Hirano ..... F04B 17/03 417/201
(Continued)

FOREIGN PATENT DOCUMENTS

CN 1057088 A 12/1991
CN 1064847 9/1992
(Continued)

OTHER PUBLICATIONS

Position Energy Collecting Device for Ascending or Descending Working Machine (Nishimura, S; JP 05163745A; Machine translation provided by ProQuest Nov. 17, 2015).*
(Continued)

*Primary Examiner* — F. Daniel Lopez
*Assistant Examiner* — Richard Drake
(74) *Attorney, Agent, or Firm* — Hasse & Nesbitt LLC; Daniel F. Nesbitt

(57) ABSTRACT

A lifting system for a jib of an operating machine that includes an energy storage device having an energy storage cylinder and an accumulator, the energy storage cylinder having an upper chamber, a lower chamber, and an energy storage piston rod connected to the jib. The upper part of the accumulator is filled with gas, and the lower part of the accumulator is filled with hydraulic oil and communicates with the lower chamber of the energy storage cylinder. The lifting system also includes a hydraulic pump and a control cylinder for controlling the lifting of the jib, which comprises an upper chamber, a lower chamber, and a control piston rod connected to the jib.

15 Claims, 1 Drawing Sheet

(51) Int. Cl.
*F15B 13/02* (2006.01)
*B66C 13/20* (2006.01)
*F15B 21/14* (2006.01)

(52) U.S. Cl.
CPC ..... *E02F 9/2271* (2013.01); *F15B 1/024* (2013.01); *F15B 21/14* (2013.01); *F15B 2211/212* (2013.01); *F15B 2211/62* (2013.01); *F15B 2211/7107* (2013.01); *F15B 2211/88* (2013.01)

(58) Field of Classification Search
USPC ..... 60/414, 418, 415, 516
See application file for complete search history.

(56) References Cited

U.S. PATENT DOCUMENTS

| | | | | |
|---|---|---|---|---|
| 6,918,247 | B1 | 7/2005 | Warner | |
| 7,055,317 | B2 * | 6/2006 | Knapp | F04B 23/026 60/413 |
| 7,296,407 | B2 * | 11/2007 | Rose | B60K 6/12 60/414 |
| 7,434,391 | B2 | 10/2008 | Asam et al. | |
| 8,589,038 | B2 | 11/2013 | Hagiwara et al. | |
| 2005/0066655 | A1 * | 3/2005 | Aarestad | E02F 9/2217 60/413 |
| 2010/0018195 | A1 * | 1/2010 | Stanger | E02F 9/2217 60/414 |
| 2015/0107466 | A1 * | 4/2015 | Kurz | B30B 15/163 100/269.05 |
| 2015/0115512 | A1 * | 4/2015 | Ruan | F16F 9/065 267/140.11 |
| 2015/0184470 | A1 * | 7/2015 | Megens | E21B 19/006 166/355 |

FOREIGN PATENT DOCUMENTS

| | | | |
|---|---|---|---|
| CN | 2561926 | Y | 7/2003 |
| CN | 1958972 | A | 5/2007 |
| CN | 1987124 | A | 6/2007 |
| CN | 101435451 | A | 5/2009 |
| CN | 201297307 | | 8/2009 |
| CN | 2012973077 | Y | 8/2009 |
| CN | 101580207 | | 11/2009 |
| CN | 101580207 | A | 11/2009 |
| CN | 101782085 | A | 7/2010 |
| CN | 201679802 | U | 12/2010 |
| CN | 202056123 | | 11/2011 |
| DE | 3232163 | A1 | 3/1984 |
| DE | 4438899 | C1 | 9/1995 |
| EP | 2287105 | | 9/2012 |
| JP | H04-120324 | A | 4/1992 |
| JP | H05-163745 | A | 6/1993 |
| JP | H06-159428 | A | 6/1994 |
| JP | H08-26555 | B2 | 3/1996 |
| JP | 2002-317848 | A | 10/2002 |
| JP | 2004028212 | A | 1/2004 |
| JP | 2004-116675 | A | 4/2004 |
| JP | 2004162846 | A | 6/2004 |
| SU | 1214857 | A | 2/1986 |
| SU | 1273464 | A1 | 11/1986 |
| SU | 1016449 | A1 | 5/1987 |
| WO | 9716371 | A1 | 5/1997 |
| WO | 9833989 | A1 | 8/1998 |
| WO | 2008013466 | A1 | 1/2008 |
| WO | 2010089518 | A1 | 8/2010 |
| WO | 2010107002 | A1 | 9/2010 |

OTHER PUBLICATIONS

The American Society of Mechanical Engineers ("Graphic Symbols for Fluid Power Diagrams," 1967, United Engineering Center, New York.).*

Extended European Search Report dated Mar. 16, 2015 for corresponding European Application No. EP11861495.7 (published Jan. 29, 2014 as EP2690292), 13 pages.

First Office Action by the Korean Patent Office (w/English translation) dated May 20, 2015 for corresponding Korean Application No. 10-2013-7026898, 9 pages.

Decision to Grant by the Russian Patent Office (w/English translation) dated Apr. 13, 2015 for corresponding Russian Application No. RU2013146691, 24 pages.

First Office Action by the Japan Patent Office (w/English translation) dated Nov. 11, 2014 for corresponding Japanese Application No. JP20140500232 (published Apr. 24, 2014 as JP2014-510211A), 13 pages.

Partial Supplementary European Search Report dated Nov. 12, 2014 for corresponding European Application No. EP11861495.7 (published Jan. 29, 2014 as EP2690292), 8 pages.

First Office Action by the Russia Patent Office (English translation only) dated Dec. 8, 2014 for corresponding Russian Application No. RU2013146691, 4 pages.

International Search Report, dated Apr. 5, 2012, from corresponding International Patent Application No. PCT/CN2011/084636, filed Dec. 26, 2011 (5 pages).

International Preliminary Search Report, dated Sep. 24, 2013, from corresponding International Patent Application No. PCT/CN2011/084636, filed Dec. 26, 2011 (11 pages).

Second Office Action by the Japan Patent Office (w/English translation) dated Jun. 30, 2015 for corresponding Japanese Application No. JP20140500232 (published Apr. 24, 2014 as JP2014-510211A), 6 pages.

Examination Report issued Jul. 8, 2015, by the Chinese Intellectual Property Office (CIPO) for corresponding Chinese Patent Application No. 201110067311.6, filed Mar. 21, 2011 (9 pages).

Examination Report issued Sep. 25, 2015, by the Chinese Intellectual Property Office (CIPO) for corresponding Chinese Patent Application No. 201110443829.5, filed Dec. 12, 2011 (15 pages).

Examination Report issued Nov. 9, 2015 by the Indonesian Patent Office for corresponding Indonesian Patent Application No. W00201304664 (3 pages).

Examination Report issued Nov. 30, 2015 by the Mexican Patent Office for corresponding Mexican Patent Application No. MX/a/2013/010836 (7 pages).

Second Official Action issued by the Mexican Patent Office, dated Jun. 14, 2016, for corresponding Mexican Patent Application No. MX/a/2013/010836, filed Sep. 20, 2013 (6 pages).

* cited by examiner

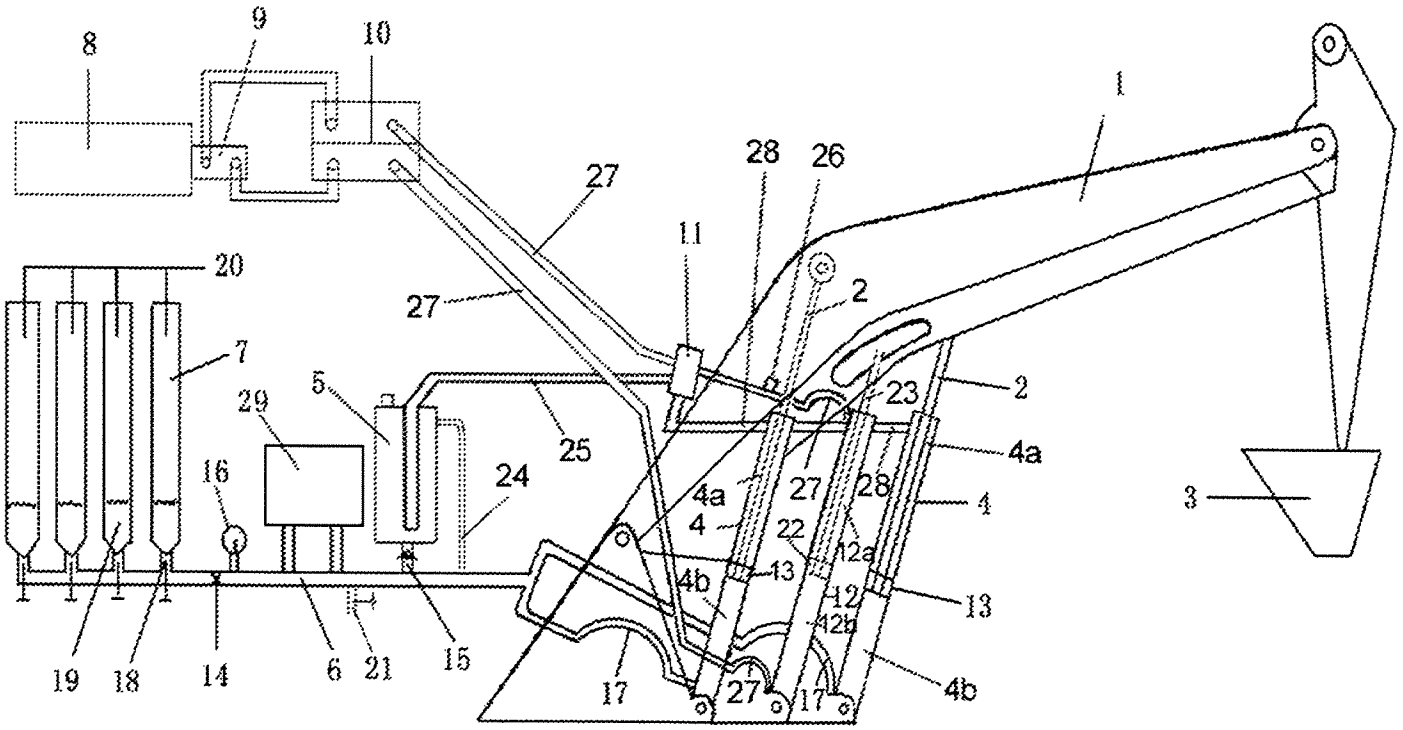
1
2
3
4
4a
4b
5
6
7
8
9
10
11
12
12a
12b
13
14
15
16
17
18
19
20
21
22
23
24
25
26
27
28
29

LIFTING SYSTEM AND LIFTING METHOD FOR JIB OF AN OPERATING MACHINE, AND AN OPERATING MACHINE THEREOF

CROSS REFERENCE TO RELATED APPLICATIONS

This application is the U.S. National Stage of International Application PCT/CN2011/084636 (pending), with an international filing date of Dec. 26, 2011, which claimed the benefit of Chinese Patent Application No. CN 201110067311.6, filed Mar. 21, 2011 and Chinese Patent Application No. CN 201110412723.9, filed Dec. 12, 2011.

FIELD OF THE INVENTION

The present invention relates to a lifting system for the jib of an operating machine, a method for lifting the jib of an operating machine by use of the lifting system and an operating machine comprising the system.

BACKGROUND

The operating machines, such as excavator, loader dozer, crane, etc., use the ascending and descending of the jib to perform operation, however, in existing lifting systems for the jib, the weight of the jib is always so great that, when the jib ascends, it's necessary for the power system of the operating machine to provide enormous force with high energy consumption, and the speed for elevating the jib is relatively low; and when the jib descends, the gravitational potential energy of the jib is often wasted and can't be effectively utilized. Although some systems capable of recycling the gravitational potential energy when jib descends have been developed, these systems are complicated in their configuration, inconvenient in operation, and cannot effectively release the recovered energy to lift the jib quickly.

SUMMARY

The present invention intends to solve the above problem in the prior art, i.e. to provide a lifting system for the jib, which is simple in its structure, easy to be operated, energy-saving, and can effectively recover and utilize the gravitational potential energy produced during the jib descending so as to lift the jib quickly.

One aspect of the present invention provides a lifting system for the jib of an operating machine, comprising: an energy storage device used for storing the gravitational potential energy during the descending of the jib and lifting the jib by use of the stored energy during the ascending of the jib, the energy storage device includes an energy storage cylinder and an accumulator, the energy storage cylinder comprises an upper chamber for energy storage cylinder and a lower chamber for energy storage cylinder which are separated by an energy storage piston and comprises an energy storage piston rod operably connected to the jib, the upper volume of the accumulator is filled with pressurized gas, and the lower volume of the accumulator is filled with pressurized hydraulic oil and is in fluid communication with the lower chamber for energy storage cylinder; a control cylinder for controlling the jib lifting, the control cylinder comprises an upper chamber for control cylinder and a lower chamber for control cylinder which are separated by a control piston, and comprises a control piston rod operably connected to the jib; a hydraulic pump for selectively supplying pressurized hydraulic oil to the upper chamber for control cylinder or the lower chamber for control cylinder through a distributor, when the hydraulic pump supplies the pressurized hydraulic oil to the upper chamber for control cylinder through the distributor, the control piston rod drives the jib to descend, and the weight of the jib pushes against the energy storage piston rod of the energy storage cylinder so that the hydraulic oil in the lower chamber for energy storage cylinder is pushed into the lower volume of the accumulator, hence the gas in the upper volume of the accumulator is compressed so as to recover the gravitational potential energy of the jib; when the hydraulic pump supplies the pressurized hydraulic oil to the lower chamber for control cylinder through the distributor, the control piston rod drives the jib to ascend so as to lift the energy storage piston rod, thereby the compressed gas in the upper volume of the accumulator pushes the hydraulic oil in the lower volume of the accumulator into the lower chamber for energy storage cylinder, and thus the recovered energy is released to push the energy storage piston rod upward for elevating the jib.

Correspondingly, the present invention further provides an operating machine comprising the jib and the above jib lifting system.

Another aspect of the present invention provides a method for lifting the jib of an operating machine by means of the above jib lifting system, comprising: filling the upper volume of the accumulator with the pressurized gas, and filling the lower volume of the accumulator and the lower chamber for energy storage cylinder, which is in fluid communication with the lower volume of the accumulator, with the pressurized hydraulic oil; making the hydraulic pump supply pressurized hydraulic oil to the upper chamber for control cylinder through the distributor such that the control piston rod drives the jib to descend, thereby the weight of the jib pushes against the energy storage piston rod of the energy storage cylinder so that the hydraulic oil in the lower chamber for energy storage cylinder is pushed into the lower volume of the accumulator, hence the gas in the upper volume of the accumulator is compressed so as to recover the gravitational potential energy of the jib; making the hydraulic pump supply pressurized hydraulic oil to the lower chamber for control cylinder through the distributor such that the control piston rod drives the jib to ascend so as to lift the energy storage piston rod, thereby the compressed gas in the upper volume of the accumulator pushes the hydraulic oil in the lower volume of the accumulator into the lower chamber for energy storage cylinder, thus the recovered energy is released so as to push the energy storage piston rod upward for elevating the jib.

The present invention substantially balances the self-weight of the jib by use of the energy stored by the energy storage device composed of an accumulator and an energy storage cylinder, wherein the accumulator and the energy storage cylinder per se constitute an entirely closed system, which only serves for energy storage and release without any control valves and may keep working unless leakage occurs. Thus, in comparison with the prior arts, the hydraulic power system of the operating machine no longer acts as an entire role in the lifting, while the system controls the lifting of the jib through the control cylinder and provides part of the thrust force. Hence, the jib lifting system of the present invention has a simple structure, is convenient to be assembled and handled, and is reliable and durable, and also the system can save energy and improve the working efficiency of the jib.

BRIEF DESCRIPTION OF THE DRAWINGS

The FIGURE is a schematic view of a lifting system for the jib of an operating machine according to an embodiment of the present invention.

LIST OF THE REFERENCE NUMERALS

1 jib
2 piston rod of an energy storage cylinder
3 weight
4 energy storage cylinder
4*a* upper chamber of the energy storage cylinder
4*b* lower chamber of the energy storage cylinder
5 hydraulic pumpstation with a hydraulic tank
6 pipeline
7 accumulator
8 engine
9 hydraulic pump
10 distributor
11 controller
12 control cylinder
12*a* upper chamber of the control cylinder
12*b* lower chamber of the control cylinder
13 piston of the energy storage cylinder
14 valve
15 one-way valve
16 hydraulic pressure gauge
17 pipeline
18 valve
19 hydraulic oil
20 gas
21 gas charging device (inflation valve)
22 piston of a control cylinder
23 piston rod of a control cylinder
24 valve
25 oil return pipeline
26 sensor
27 hydraulic pipeline
28 hydraulic pipeline
29 radiator

DETAILED DESCRIPTION

The FIGURE illustrates an embodiment of the jib lifting system of the present invention which takes the jib 1 of an excavator as an example, the excavator uses the shovel assembled at the end of the jib 1 to excavate and convey weight 3 so as to perform procedures. The jib lifting system comprises three cylinders assembled below the jib 1, wherein, the one connected below the jib 1 is a control cylinder 12, and the other two connected to either side of the jib 1 at either side of the control cylinder 12 are two energy storage cylinders 4. Each cylinder comprises cylinder body, piston and piston rod, and is separated into two chambers, i.e., an upper chamber and a lower chamber, by respective pistons 22 and 13, and these chambers are filled with hydraulic oil to push against the piston and the piston rod to move. The three cylinders are arranged side-by-side. The lower ends of the cylinders are fixed to the chassis of the excavator, and the upper ends are connected to the jib 1 by way of respective piston rods.

The lower chamber 4*b* of the energy storage cylinder 4 may be connected to the accumulator 7 through the pipeline 17 and 6. The accumulator 7 and the energy storage cylinder 4 together constitute an energy storage device. One or more accumulator 7 may be assembled so as to communicate with the energy storage cylinder 4. In this embodiment, the upper volume of the accumulator 7 is filled with pressurized gas 20, whereas the lower volume of the accumulator 7 is filled with pressurized hydraulic oil 19. An gas charging device 21 (an inflation valve in this embodiment) and a hydraulic pumpstation 5 with a hydraulic tank may be connected to the pipeline 6 which connects the accumulator 7 with the lower chamber of the energy storage cylinder 4, and the gas charging device 21 and the hydraulic pumpstation 5 are used for supplying the pressurized gas and the pressurized hydraulic oil to the accumulator 7 and the lower chamber of the energy storage cylinder 4*b*, respectively. In addition, since the hydraulic oil may generate heat during operation, a radiator 29 may also be connected to the pipeline 6 for the heat dissipation of the hydraulic oil, in order to ensure the hydraulic oil at a normal temperature. The control cylinder 12 may be connected to a hydraulic system driven by the engine 8 of the excavator via the hydraulic pipeline 27, and the hydraulic system is a hydraulic pump 9 in this embodiment. The hydraulic pump 9 may be equipped with a distributor 10, and the hydraulic pump 9 is in fluid communication with the upper chamber 12*a* and the lower chamber 12*b* of the control cylinder 12 respectively via the distributor 10 and the hydraulic pipeline 27. The distributor 10 may selectively allow the hydraulic pump 9 to supply pressurized hydraulic oil to the upper chamber 12*a* or the lower chamber 12*b* of the control cylinder 12 in response to the signals from the driver of the excavator or the manual operation of the driver.

In this embodiment, as shown the FIGURE, a controller 11 may also be provided, and the controller 11 is connected to the distributor 10 of the hydraulic pump 9, the upper chamber 12*a* of the control cylinder 12, the upper chamber 4*a* of the energy storage cylinder 4 and the hydraulic tank of the hydraumatic pumpstation 5 through the hydraulic pipelines 27, 27, and 28 and the oil return pipeline 25, respectively, so as to selectively open or close the fluid communication among the distributor 10 of the hydraulic pump 9, the upper chamber 12*a* of the control cylinder 12, the upper chamber 4*a* of the energy storage cylinder 4, and the hydraumatic pumpstation 5. Usually, the controller 11 opens the pathway from the distributor 10 to the upper chamber 12*a* of the control cylinder 12, so as to allow the hydraulic pump 9 to supply pressurized hydraulic oil to the upper chamber 12*a* of the control cylinder 12 through the distributor 10 and the controller 11, when the hydraulic pump 9 is to supply hydraulic oil to the upper chamber 12*a* of the control cylinder 12 through the distributor 10. Other control operation of the controller 11 will be described hereinafter.

In the following, it will describe a method for ascending and descending the jib 1 by means of the jib lifting system according to above embodiments of the present invention.

The jib lifting system will firstly be pre-pressurized before ascending and descending the jib 1. As shown in the FIGURE, the valve 14 provided in the pipeline 6 is firstly opened, the inflation valve 21 assembled in the pipeline 6 is used for filling gas, such as nitrogen gas, into the accumulator 7 via the pipeline 6, meanwhile the valve 24 of the hydraumatic pumpstation 5 is closed so as to prevent the gas from running out through the pipeline 6 and the hydraumatic pumpstation 5. When the gas pressure reaches to a certain level, the gas filling is stopped, and the inflation valve 21 is closed. Then, the valve 24 is opened, and the hydraumatic pumpstation 5 is operated to fill the hydraulic oil into the accumulator 7 and the lower chamber of the energy storage cylinder 4 connected thereto via a one-way valve 15, and correspondingly, the gas inside the pipelines 6, 17 and the lower chamber of the energy storage cylinder 4 is vented via the valve 24 by the hydraulic oil. When the pressure reading of the hydraulic pressure gauge 16 assembled on the pipeline 6 reaches to a certain requirement, the hydraumatic pumpstation 5 is turned off and the filling of the hydraulic oil is stopped. At the moment, the upper volume of the accumulator 7 is filled with pressurized gas 20, and the lower volume of the accumulator 7 and the lower chamber 4*b* of the energy storage cylinder, which is in fluid communication with the lower volume of the accumulator 7, are filled with pressurized hydraulic oil 19 (wherein, the specific gravity of the gas 20 is comparatively lower, whereas the specific gravity of the hydraulic oil 19 is comparatively higher, and thereby the gas 20 is always kept in the upper volume of the accumulator 7, and the hydraulic oil 19 is always kept in the lower volume); moreover, a certain pressure exists in the accumulator 7 and the lower chamber 4*b* of the energy storage cylinder, wherein this pressure may be set in such a manner that the force by the hydraulic oil in the accumulator 7 applied to the piston rod 2 of the energy storage cylinder 4 substantially balances with the force applied to the piston rod 2 by the weight of the jib 1.

After filling the gas and hydraulic oil for prepressurization as described above, the energy storage device constituted by the accumulator 7 and the energy storage cylinder 4 becomes a closed system, which may operate all the time without refilling the gas and hydraulic oil unless leakage occurs. Even if leakage occurs, it's possible to compensate the pressurized gas and pressurized hydraulic oil to the accumulator 7 and the lower chamber 4*b* of the energy storage cylinder 4 by means of the gas charging device 21 and the hydraumatic pumpstation 5, until the force imposed on the piston rod 2 of the energy storage cylinder 4 by the hydraulic oil in the accumulator 7 substantially balances with the force imposed on the piston rod 2 by the weight of the jib 1.

After the above prepressurization, the jib lifting system may be used to make the jib 1 ascend and descend. First, the engine 8 is started to make the hydraulic system (hydraulic pump 9) get to work. When it needs the jib 1 to descend, the driver of the operating machine pushes a control lever to send a signal to the distributor 10 of the hydraulic pump 9, then the distributor 10 delivers the hydraulic oil to the upper chamber of the control cylinder 12, so that the piston rod 23 of the control cylinder 12 descends and thus the jib 1 descends. At the moment, the weight of the jib 1 (and the weight 3) is imposed on the energy storage cylinder 4 entirely. Thus, the potential energy, which is produced during the descending of the jib due to its self-weight, is utilized to actuate the energy storage cylinder 4, so that the hydraulic oil under the piston rod of the energy storage cylinder 4 is compressed, and the pressure starts to rise and thus forces the hydraulic oil under the piston rod of the energy storage cylinder 4 from the oil inlet at the bottom of the accumulator 7 to the inside of the accumulator 7 via the pipeline 6. As the hydraulic oil being forced from the oil inlet at the bottom of the accumulator 7 to the inside of the accumulator 7, the inside gas space of the accumulator 7 is decreased, and thus the gas 20 in the upper volume of the accumulator 7 is compressed so as to achieve the purpose of energy storage. When it needs the jib 1 to ascend, the driver of the operating machine pushes the control lever to send a signal to the distributor 10 of the hydraulic system, the distributor 10 delivers the hydraulic oil to the lower chamber of the control cylinder 12, so that the piston rod 23 of the control cylinder 12 ascends and thus the jib 1 ascends. In this way, the pressure balance between the hydraulic oil in the lower chamber of the energy storage cylinder 4 and that in the accumulator 7 is broken. By this time, the internal pressure of the lower chamber of the energy storage cylinder 4 starts to drop, and the pressure of the hydraulic oil inside of the accumulator 7 is higher than that in the lower chamber of the energy storage cylinder 4. Then the high pressure hydraulic oil 19 in the accumulator 7 flows into the lower chamber of the energy storage cylinder 4 via the pipeline 6, so that the piston rod 2 of the energy storage cylinder 4 is pushed to move upward and thus the jib 1 ascends quickly and easily.

In prior arts, the vertical reciprocating motion of the jib 1 is forced by the hydraulic systems 9 and 10 of the engine 8, while the present invention uses the accumulator 7 and the energy storage cylinder 4 to balance the weight of the jib 1 and that of the weight 3. In this way, the hydraulic pump 9 and the distributor 10 of the engine 8 no longer play a sole part in the lifting of the jib 1, and they just control the vertical reciprocating motion of the jib 1 and provide partial driving force. One of the characteristics of the present invention is that the control cylinder 12 is utilized to control the ascending and descending of the jib; and another characteristic is that the energy storage cylinder 4 and the accumulator 7 of the jib 1 are used for energy storage, wherein the accumulator 7 and the energy storage cylinder 4 per se have no control valves, and they are just for energy storage and release of energy so as to keep a substantial balance between the weight of the jib 1 and the pressure in the accumulator 7. Thus, it's possible to decrease the hydraulic power required in the lifting of the jib 1 that is provided by the hydraulic pump 9 toward the control cylinder 12, thereby it may save the fuel consumption of the engine 8 and speed up the lifting of the jib 1, in comparison with the prior arts. That is to say, according to the present invention, with the cooperation of the energy storage cylinder 4, the accumulator 7 stores gravitational potential energy caused by the self-weight of the jib 1 during its descending, and releases the stored energy during the ascending of the jib 1 so as to assist and speed up the ascending. In this way, it's possible to effectively recover and utilize the gravitational potential energy during the jib 1 descending, and improve the operating efficiency of the operating machine.

Furthermore, the energy storage device constituted by the energy storage cylinder 4 and the accumulator 7 is not connected with the main hydraulic system 9, but a separate mechanism which is provided to balance the self-weight of the jib 1. Thus, it's unnecessary to worry about that too much energy would be consumed for the self-weight of the jib 1 during the ascending and descending of the jib 1, thereby the jib 1 may be made heavier so as to reinforce the strength of the jib 1.

The jib lifting system according to the present invention has simple structure, is easy to assemble, is reliable and durable for use, and is easy and simple to handle, thus it is capable to provide remarkable energy-saving effect.

Next, a description regarding the specific operations of the controller 11 will be stated. During the ascending of the jib 1, which is controlled by the control cylinder 12, the controller 11 opens the pathway from the upper chamber 4*a* of the energy storage cylinder 4 to the hydraulic tank of the hydraumatic pumpstation 5, so as to allow the hydraulic oil in the upper chamber 4*a* of the energy storage cylinder 4*a* to return to the hydraulic tank via the oil return pipeline 25 with the assignment by the controller 11; when the control cylinder 12 makes the jib 1 descend, the piston 13 in the energy storage cylinder 4 begins to descend, then the upper chamber 4*a* of the energy storage cylinder 4 is evacuated so as to draw the hydraulic oil from the hydraulic tank of the hydraumatic pumpstation 5 to the upper chamber 4*a* via the controller 11; if more force is needed when the control cylinder 12 moves downward the jib 1 (i.e., the driving force by the pressure in the upper chamber of the control cylinder 12 is insufficient), the pressure in the upper chamber of the control cylinder gets higher, and by this time, a signal may be sent to the controller 11 so that the controller 11 closes the pathway from the upper chamber of the energy storage cylinder 4 to the hydraulic tank of the hydraumatic pumpstation 5, and simultaneously opens the pathway from the distributor 10 to the upper chamber of the energy storage cylinder 4, and thus the pressurized hydraulic oil supplied by the hydraulic pump 9 could also be delivered to the upper chamber of the energy storage cylinder 4 through the distributor 10 and the controller 11. That is to say, at the moment the controller 11 communicates the upper chamber of the energy storage cylinder 4 with the upper chamber of the control cylinder 12 in a parallel way. Thus, the action area is increased from the area of the upper chamber of the control cylinder 12 to the area of the upper chambers of multiple cylinders, which increases the thrust force by the upper chamber of cylinder and further pushes the pistons of the cylinders downward, and hereby the acting force for descending the jib 1 is increased. Here, for example, when the sensor 26, which is arranged in the pipeline 27 or in the upper chamber of the control cylinder, detects that the pressure in the upper chamber 12*a* of the control cylinder 12 exceeds a predetermined value, it indicates that more downthrust is required, and then the sensor 26 sends a signal to notify the controller 11 to communicate the upper chamber of the control cylinder 12 with the upper chamber of the energy storage cylinder 4 so as to assist in descending the jib 1.

It should be noted here that there are embodiments without the controller 11. For instance, the hydraulic oil is directly supplied to the upper chamber of the control cylinder 12 by the distributor 10, and in this case, the upper chamber of the energy storage cylinder 4 and the hydraulic tank of the hydraumatic pumpstation 5 are directly communicated with each other without the participation of the controller 11; in another embodiment, the distributor 10 directly supplies the hydraulic oil to the upper chamber of the control cylinder 12 and the upper chamber of the energy storage cylinder 4 in a parallel way; and it's also possible for the distributor 10 to supply the hydraulic oil to the upper chamber of the energy storage cylinder 4 directly, and here the upper chamber of the control cylinder 12 and the hydraulic tank are directly communicated with each other without the participation of the controller 11. All of these manners can achieve the effect of controlling the lifting of the jib 1, except that the velocity and thrust force for the ascending and descending of the jib 1 are not as good as those in the case having the controller 11.

The ascending and descending of the jib 1 are performed alternately and reciprocally until the operating machine stop working. When the machine is shut down, the valve 14 in the pipeline 6 may be closed so as to avoid the pressurized hydraulic oil in the accumulator 7 pushing the jib and thus making it ascend automatically without manual control. In addition, an individual valve 18 may be provided for the accumulator 7, in order to improve the safety, as well as the convenience when replacing the accumulator.

During the working process in which the jib 1 ascends and descends, the pressure in the closed system constituted by the accumulator 7 and the energy storage cylinder 4 would fluctuate due to the lifting of the jib 1. However, since the force resulting from the weight of the jib 1, which is applied to the piston rod of the energy storage cylinder, would fluctuate correspondingly due to the lifting of the jib, the force applied to the piston rod of the energy storage cylinder by the hydraulic oil inside of the accumulator 7 is always kept substantially balance with the force applied to the piston rod of the energy storage cylinder by the weight of the jib 1, so that the force and energy provided by the hydraulic system of the engine is saved. Nonetheless, the magnitude of the pressure in the closed system constituted by the accumulator 7 and the energy storage cylinder 4 may also be regulated as required (by charging and releasing the gas and/or the oil by the gas charging device 21 and/or the hydraumatic pumpstation 5, for example).

Some embodiments of the present invention have been described in the above, however, the number of the energy storage cylinder and the control cylinder and the relative location combinations thereof are not limited to those described in the above embodiments. Any suitable number (for example, one, two or more) of the energy storage cylinders and any suitable number (for example, one, two or more) of the control cylinders may be provided at either side or in the middle or at both sides of the jib 1, and the energy storage cylinder and the control cylinder may also work by swapping their positions.

The present invention substantially balances the self-weight of the jib by use of the energy stored by the energy storage device composed of an accumulator and an energy storage cylinder, wherein the accumulator and the energy storage cylinder per se constitute an entirely closed system, which only serves for energy storage and release without any control valves and may keep working unless leakage occurs. Thus, in comparison with the prior arts, the hydraulic power system (driven by the engine) of the operating machine no longer acts as an entire role in the lifting, while the system controls the lifting of the jib through the control cylinder and provides part of the thrust force. Hence, the jib lifting system of the present invention has a simple structure, is convenient to be assembled and handled, and is reliable and durable, and also the system can save energy and improve the working efficiency of the jib.

The jib lifting system of the present invention is applicable to any operating machines having a jib, such as, excavator, loader dozer, crane, and so on.

Apparently, various revisions and modifications may be made to the above disclosed embodiments by the skilled person in this art without departing from the scope or spirit of the present invention. According to the implementation of the present invention disclosed in this specification, other embodiments of the present invention would be obvious to the skilled person of this art. The specification and its disclosed examples should be construed to be solely illustrative; the true scope of the present invention is defined by the appended claims.

What is claimed is:

1. A lifting system for a jib of an operating machine, comprising:

an energy storage device used for storing the gravitational potential energy during the descending of the jib and lifting the jib by use of the stored energy during the ascending of the jib, the energy storage device includes an energy storage cylinder and an accumulator, the energy storage cylinder comprising an upper chamber and a lower chamber which are separated by an energy storage piston, wherein the energy storage piston comprises an energy storage piston rod operably connected to the jib, wherein an upper volume of the accumulator is filled with a pressurized gas, and a lower volume of the accumulator is filled with a pressurized hydraulic oil, where in an operating mode of the operating machine, in which the lifting system is operated for ascending and descending the jib, the lower chamber of the energy storage cylinder and the lower volume of the accumulator are always kept in direct fluid communication via a first pipeline, to provide a closed system to automatically store energy in the accumulator when the jib descends and to release energy to the energy control cylinder when the jib ascends under control; and in a shutdown mode of the operating machine, in which operation of the jib to ascend and descend is stopped, a valve in the first pipeline can be closed;

a control cylinder for controlling the jib lifting, the control cylinder comprising an upper chamber and a lower chamber which are separated by a control piston, wherein the control piston comprises a control piston rod operably connected to the jib;

a hydraulic pump for selectively supplying the pressurized hydraulic oil to the upper chamber of the control cylinder or the lower chamber of the control cylinder through a distributor via a second pipeline independent of the first pipeline; wherein when the hydraulic pump supplies the pressurized hydraulic oil to the upper chamber of the control cylinder through the distributor, the control piston rod drives the jib to descend, and the weight of the jib pushes against the energy storage piston rod of the energy storage cylinder so that the hydraulic oil in the lower chamber of the energy storage cylinder is pushed into the lower volume of the accumulator, hence the pressurized gas in the upper volume of the accumulator is compressed so as to recover the gravitational potential energy of the jib; and wherein when the hydraulic pump supplies the pressurized hydraulic oil to the lower chamber of the control cylinder through the distributor, the control piston rod drives the jib to ascend so as to lift the energy storage piston rod, thereby the compressed gas in the upper volume of the accumulator pushes the hydraulic oil in the lower volume of the accumulator into the lower chamber of the energy storage cylinder, and thus the recovered energy is released to push the energy storage piston rod for elevating the jib;

a controller and a sensor, where the controller is connected to the distributor equipped to the hydraulic pump, the upper chamber of the energy storage cylinder, the upper chamber of the control cylinder and a hydraulic tank, respectively, and the controller is configured in such a manner that:

the pathway from the hydraulic pump to the upper chamber of the control cylinder via the distributor is opened, when the hydraulic pump is to supply the hydraulic oil to the upper chamber of the control cylinder through the distributor, so as to allow the hydraulic pump to supply pressurized hydraulic oil to the upper chamber of the control cylinder through the distributor and the controller;

the pathway from the upper chamber of the energy storage cylinder to the hydraulic tank is opened when the jib ascends, so as to allow the hydraulic oil in the upper chamber of the energy storage cylinder to return to the hydraulic tank via the controller;

the pathway from the hydraulic tank to the upper chamber of the energy storage cylinder is opened when the jib descends, so as to allow the hydraulic oil in the hydraulic tank to be drawn into the upper chamber of the energy storage cylinder via the controller; and when the sensor detects that the pressure of the hydraulic oil, which is delivered into the upper chamber of the control cylinder by the hydraulic pump through the distributor and controller, exceeds a predetermined value, in response to a signal from the sensor, the pathway from the hydraulic pump to the upper chamber of the energy storage cylinder via the distributor is opened and the pathway from the upper chamber of the energy storage cylinder to the hydraulic tank is closed, so that the hydraulic pump can supply pressurized hydraulic oil to the upper chamber of the control cylinder and the upper chamber of the energy storage cylinder through the distributor and the controller at the same time.

2. The lifting system according to claim 1, wherein, the pressure of the gas and hydraulic oil filled into the accumulator is set in such a manner that the force applied to the energy storage piston rod by the hydraulic oil in the accumulator substantially balances with the force applied to the energy storage piston rod by the weight of the jib.

3. The lifting system according to claim 2, further comprising a gas charging device and a hydraulic pumpstation, which are connected between the accumulator and the lower chamber of the energy storage cylinder, wherein the gas charging device is used for supplying pressurized gas to the accumulator and the lower chamber of the energy storage cylinder, and the hydraulic pumpstation is used for supplying pressurized hydraulic oil to the accumulator and the lower chamber of the energy storage cylinder.

4. The lifting system according to claim 2, further comprising a radiator, which is connected in the hydraulic oil pathway between the accumulator and the lower chamber of the energy storage cylinder so as to provide heat dissipation for the hydraulic oil.

5. The lifting system according to claim 1, wherein, the pressure of the gas and hydraulic oil filled into the accumulator can be adjusted as required.

6. The lifting system according to claim 5, wherein, further comprising a gas charging device and a hydraulic pumpstation, which are connected between the accumulator and the lower chamber of the energy storage cylinder, wherein the gas charging device is used for supplying pressurized gas to the accumulator and the lower chamber of the energy storage cylinder, and the hydraulic pumpstation is used for supplying pressurized hydraulic oil to the accumulator and the lower chamber of the energy storage cylinder.

7. The lifting system according to claim 5, further comprising a radiator, which is connected in the hydraulic oil pathway between the accumulator and the lower chamber of the energy storage cylinder so as to provide heat dissipation for the hydraulic oil.

8. The lifting system according to claim 1, wherein, the distributor is controlled by manipulating an operating handle by the driver of the operating machine, so as to selectively supply pressurized hydraulic oil to the upper chamber of the control cylinder and/or the upper chamber of the energy storage cylinder or supply pressurized hydraulic oil to the lower chamber of the control cylinder.

9. The lifting system according to claim 1, further comprising a gas charging device and a hydraulic pumpstation, which are connected between the accumulator and the lower chamber of the energy storage cylinder, wherein the gas charging device is used for supplying pressurized gas to the accumulator and the lower chamber of the energy storage cylinder, and the hydraulic pumpstation is used for supplying pressurized hydraulic oil to the accumulator and the lower chamber of the energy storage cylinder.

10. The lifting system according to claim 1, further comprising a radiator, which is connected in the hydraulic oil pathway between the accumulator and the lower chamber of the energy storage cylinder so as to provide heat dissipation for the hydraulic oil.

11. The lifting system according to claim 1, wherein, the amount of the control cylinder is one or more, the amount of the energy storage cylinder is one or more, and the control cylinder and the energy storage cylinder can interchange their positions.

12. The lifting system according to claim 11, wherein, one control cylinder, and two energy storage cylinders located at either side of the control cylinder, are assembled in parallel below the jib.

13. An operating machine, comprising a jib and the lifting system according to claim 1.

14. A method for lifting a jib of an operating machine by means of the lifting system for the jib of the operating machine according to claim 1, comprising the steps of:

a) filling the upper volume of the accumulator with the pressurized gas, and filling the lower volume of the accumulator and the lower chamber of the energy storage cylinder, which is in fluid communication with the lower volume of the accumulator, with the pressurized hydraulic oil;

b) making the hydraulic pump supply pressurized hydraulic oil to the upper chamber of the control cylinder through the distributor such that the control piston rod drives the jib to descend, thereby the weight of the jib pushes against the energy storage piston rod of the energy storage cylinder so that the hydraulic oil in the lower chamber of the energy storage cylinder is pushed into the lower volume of the accumulator, hence the gas in the upper volume of the accumulator is compressed so as to recover the gravitational potential energy of the jib;

c) making the hydraulic pump supply pressurized hydraulic oil to the lower chamber of the control cylinder through the distributor such that the control piston rod drives the jib to ascend so as to lift the energy storage piston rod, thereby the compressed gas in the upper volume of the accumulator pushes the hydraulic oil in the lower volume of the accumulator into the lower chamber of the energy storage cylinder, thus the recovered energy is released so as to push the energy storage piston rod to uplift the jib; and wherein, the lifting system further comprises a controller and a sensor, wherein the controller is connected to the distributor equipped to the hydraulic pump, the upper chamber of the energy storage cylinder, the upper chamber of the control cylinder and a hydraulic tank, respectively, the method further comprising the step of:

d) opening the pathway from the hydraulic pump to the upper chamber of the control cylinder via the distributor by means of the controller, when the hydraulic pump is to supply the hydraulic oil to the upper chamber of the control cylinder through the distributor, so as to allow the hydraulic pump to supply pressurized hydraulic oil to the upper chamber of the control cylinder through the distributor and the controller; wherein when the jib ascends, making the hydraulic oil in the upper chamber of the energy storage cylinder return to the hydraulic tank via the controller; when the jib descends, making the hydraulic oil in the hydraulic tank be drawn into the upper chamber of the energy storage cylinder via the controller; and when by use of the sensor detecting that the pressure of the hydraulic oil, which is delivered into the upper chamber for control cylinder by the hydraulic pump through the distributor and controller, exceeds a predetermined value, making the sensor send a signal to the controller such that the controller opens the pathway from the hydraulic pump to the upper chamber of the energy storage cylinder via the distributor and closes the pathway from the upper chamber of the energy storage cylinder to the hydraulic tank, so as to allow the hydraulic pump to simultaneously supply pressurized hydraulic oil to the upper chamber of the control cylinder and the upper chamber of the energy storage cylinder through the distributor and the controller.

15. The method according to claim 14, wherein, in the step a), the pressure of the gas and hydraulic oil filled into the accumulator is set in such a manner that the force applied to the energy storage piston rod by the hydraulic oil in the accumulator substantially balances with the force applied to the energy storage piston rod by the weight of the jib.

* * * * *